US006114659A

United States Patent [19]

Finck et al.

[11] Patent Number: 6,114,659

[45] Date of Patent: Sep. 5, 2000

[54] DEVICE AND METHOD FOR KEEPING FOOD WARM

[75] Inventors: Mark H. Finck, Davie, Fla.; James M. Wasner, Shreveport, La.; Henry T. Ewald, Schaumburg, Ill.

[73] Assignee: The Frymaster Corporation, Shreveport, La.

[21] Appl. No.: 09/292,205

[22] Filed: Apr. 15, 1999

[51] Int. Cl.[7] ..... A47F 3/04; F24B 7/00; F24F 13/04

[52] U.S. Cl. ..... 219/214; 219/400; 312/236; 99/474

[58] Field of Search ..... 219/385, 386, 219/400, 449.1, 460.1, 214; 99/473, 474, 476, 483; 126/21 A; 165/104.3, 918; 312/236; 432/64, 122; 62/255, 256

[56] References Cited

U.S. PATENT DOCUMENTS

| | | | |
|---|---|---|---|
| 2,967,404 | 1/1961 | Detwiler | 62/256 |
| 3,543,532 | 12/1970 | Gatton et al. | 62/256 |
| 3,713,401 | 1/1973 | McClurkin | 432/64 |
| 3,780,794 | 12/1973 | Staub | 219/400 |
| 3,942,426 | 3/1976 | Binks et al. . | |
| 3,962,962 | 6/1976 | Anderson | 219/386 |
| 4,038,968 | 8/1977 | Rovell . | |
| 4,106,305 | 8/1978 | Ibrahim | 62/256 |
| 4,233,495 | 11/1980 | Scoville et al. . | |
| 4,295,340 | 10/1981 | Abraham | 62/256 |
| 4,327,279 | 4/1982 | Guibert . | |
| 4,329,852 | 5/1982 | Ibrahim et al. | 62/256 |
| 4,437,396 | 3/1984 | Plattner et al. . | |
| 4,455,478 | 6/1984 | Guibert . | |
| 4,592,209 | 6/1986 | Casanova et al. | 62/255 |
| 4,822,981 | 4/1989 | Chaudoir . | |
| 5,276,309 | 1/1994 | Hasse et al. . | |
| 5,282,264 | 1/1994 | Reeves et al. | 219/385 |

*Primary Examiner*—Joseph Pelham
*Attorney, Agent, or Firm*—Ohlandt, Greeley, Ruggiero & Perle, L.L.P.

[57] ABSTRACT

A food warming device having a bin for holding food products. The bin has an air delivery port and an air intake port located at first and second end walls that are disposed at first and second opposite edges of the bottom portion. The regions above the bottom portion and along the third and fourth opposite edges between the first and second walls are substantially open whereby the food products are clearly visible to customers. The bottom portion has a heated surface for receiving food products to be warmed. An air circulating means forms a stream of circulating heated air that moves from the air delivery port over the heated surface to the air intake port. The food products are warmed by heat emanating from the heated surface and by warm air from the stream of circulating heated air. A balancing system maintains the circulating air in balance by diverting a portion of the return air to ambient atmosphere through a bleed exhaust port.

15 Claims, 5 Drawing Sheets

DEVICE AND METHOD FOR KEEPING FOOD WARM

FIELD OF INVENTION

This invention relates to a device and method for keeping food products warm. In particular, the invention relates to a device and method that uses both a heated surface and a moving heated air curtain to warm packaged food products, such as sandwiches and other food offerings.

BACKGROUND OF INVENTION

Food-warming devices are used in the fast food industry to keep freshly prepared food products warm for several minutes. Prior art food-warming devices have engulfed the food products with warm air for up to ten minutes without serious degradation of quality of the food product. An important feature is to keep the food products visible to customers for selection purposes.

One example of a prior art food-warming device is disclosed in U.S. Pat. No. 4,822,981. This device has an inclined heated plate upon which food is held. A plurality of infrared heating lamps are disposed over the plate to provide heated air directed downwardly onto the food. A disadvantage of this prior art food-warming device is that the heat lamps visibly give the impression of a food-warming device. This can give a customer an impression that the food product was cooked sometime ago and has been warmed for an indefinite time.

Another prior art food-warming device comprises an enclosed sandwich bin that has open front and rear service openings. To insulate the bin from heat loss to ambient atmosphere, a warm air circulating system provides moving air curtains for the front and rear service openings. An example of this type of food-warming device, shown in U.S. Pat. No. 3,942,426, diffuses some of the recirculating air into the bin to maintain a bin temperature well above ambient temperature. However, there is relatively little air motion in the bin. The device also includes an air chamber through which ambient air may pass by convection to keep a wall of the device cool to the touch. This food-warming device has a top and two sides that conceal the food products from the customer's view.

Another prior art enclosed sandwich bin type of food-warming device, One example of this type of food-warming device, shown in U.S. Pat. No. 4,437,396, directs the recirculating air away from the service openings and into the bin to form a dome of hot, moist air above the sandwiches. Again, this food-warming device has a top and two sides that conceal the food products from the customer's view.

Other prior art food-warming devices that use recirculating hot air to heat or warm food products are shown in U.S. Pat. Nos. 4,233,495, 4,327,279, 4,455,478 and 5,276,309. However, these food-warming devices have chest type enclosures that conceal the food products from the customer's view.

Another prior art food-warming device applicable to a food-warming table such as used in cafeterias is disclosed in U.S. Pat. No. 4,038,968.

This device employs a food holding pan that fits in a receptacle contained directly within the table. The pan is heated from below by an electrical heater. A moving air stream is circulated across the top of the pan to retard loss of heat and prevent moisture from leaving the food. The air stream picks up heat and moisture that rises from the food products. This device, being designed for use in a cafeteria, is unsuitable for use in a fast food restaurant.

What is needed is a food-warming product that has no visible heat source, but yet holds the food products visible to customers.

The present invention provides a food-warming device having a food product bin that holds food products that are visible, but yet does not have any visible heat emitting sources, such as overhead heating lamps.

The present invention provides a method of warming food by a combination of heat supplied by a heated plate and heat supplied by a circulating stream of heated air. The circulating stream of heated air contacts the food products with warm air as well as provides a barrier to heat and moisture loss to ambient air.

SUMMARY OF INVENTION

A food-warming device according to the present invention has a food product bin. The bin has a bottom portion with first and second opposed edges and third fourth opposed edges. A first and a second end wall are disposed at the first and second opposite edges of the bottom portion. The regions above the bottom portion and along the third and fourth opposite edges between the first and second walls are substantially open. The bottom portion has a heated surface for receiving food products to be warmed. An air circulating means forms a circulating stream of heated air that moves from an air delivery port disposed in the first end wall over the heated surface to an air intake port disposed in the second end wall. The food products are warmed by heat emanating from said heated surface and by warm air from the circulating stream of heated air.

In a preferred embodiment, the air circulating means is located in a duct system disposed in the bottom portion and in the first and second end walls. The circulating air is formed by a mixture of air from the circulating stream of heated air and ambient air. The duct system includes a balancing system that maintains the circulating air in balance by diverting a portion of the air mixture to ambient atmosphere through a bleed exhaust port. The balancing system includes a bleed divider that diverts a portion of the air mixture to the bleed exhaust port. The air that is bled off is fed through bleed ducts that have external surfaces in a location exposed to touching by human hands. The bled off air serves to maintain these external surfaces cool.

The method of warming food products according to the present invention comprises the steps of:

positioning the food products on a heated plate;

circulating air to form a circulating stream of heated air; and directing the circulating stream of heated air over the heated surface and in contact with the food products; whereby the food products are warmed by heat emanating from the heated plate and by the heated air from the circulating stream of heated air.

In a preferred embodiment, the circulating stream of air comprises a mixture of recycled air from the circulating stream of heated air and ambient air. The circulating air is maintained in balance by diverting a portion of the recycled air to ambient atmosphere.

BRIEF DESCRIPTION OF DRAWINGS

Other and further objects, advantages and features of the present invention will be understood by reference to the following specification in conjunction with the accompanying drawings, in which like reference characters denote like elements of structure and.

DESCRIPTION OF PREFERRED EMBODIMENT

Figure 1:
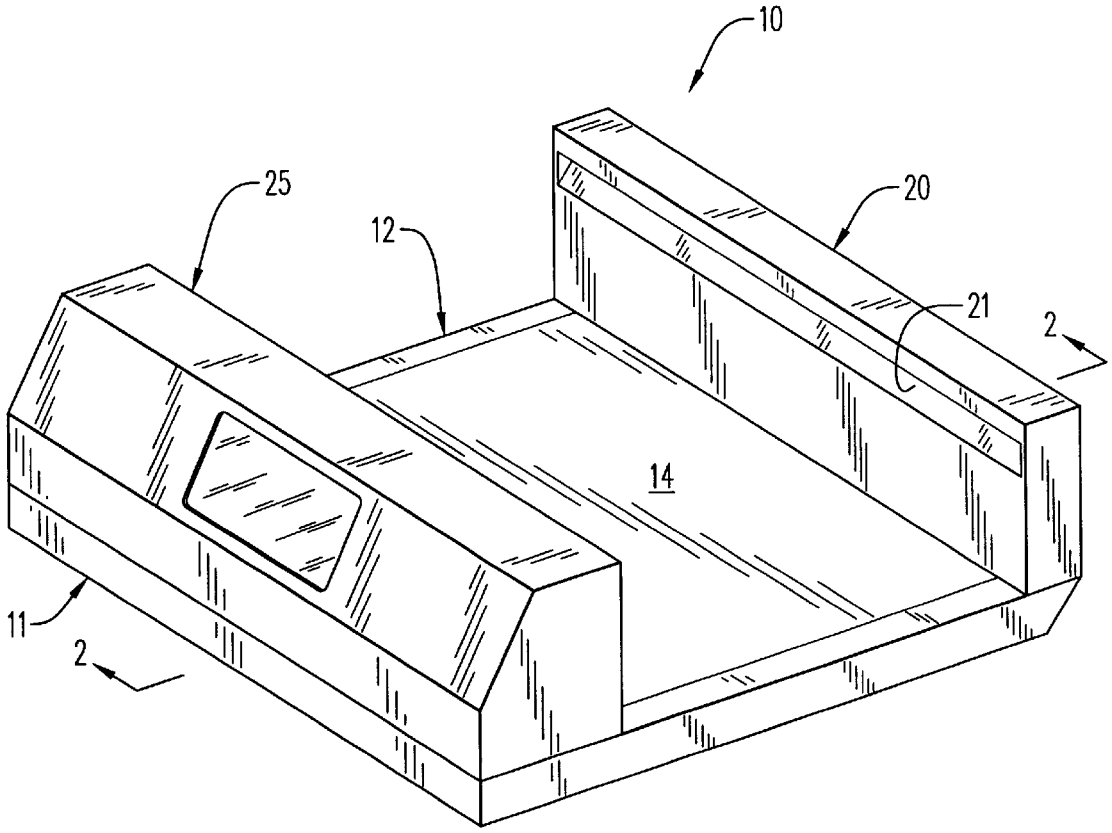
FIG. 1 is a perspective view of a food-warming device according to the present invention.
Figure 2:
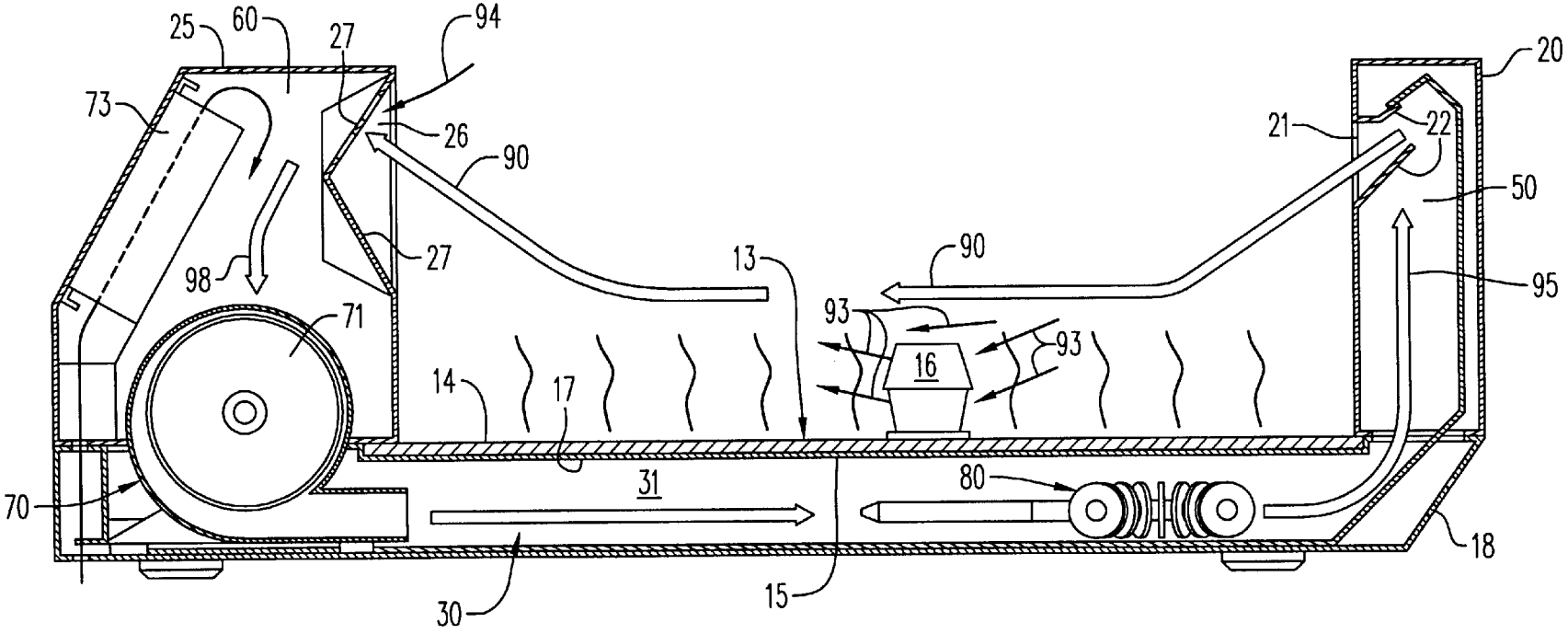
FIG. 2 is a is side elevation view taken along line 2—2 of FIG. 1.

With reference to FIGS. 1 and 2, there is provided a food-warming device, generally represented by numeral 10. Food-warming device 10 has a food product bin 11, a duct system 30 and an air circulation system 70.

Bin 11 has a bottom portion 12, a first end wall 20 and a second end wall 25. Bottom portion 12 has a plate 13 with a top surface 14 upon which a food product 16 is situated for warming. Although only a single food product 16 is shown in FIG. 2, it is understood that a plurality of such food products can be situated on surface 14 for warming. A heater 15 is arranged along a bottom surface 17 for heating plate 13. Heat emanating from plate 13 provides heat that warms food product 16. The regions above bottom portion 12 and between end walls 20 and 25 are substantially open whereby food product 16 is clearly visible to customers.

Duct system 30 is arranged in bottom portion 12 and in first and second end walls 20 and 25. To this end, duct system 30 has a bottom duct passage 31 disposed in bottom portion 12, a first duct passage 50 disposed in first end wall 20 and a second duct passage 60 disposed in second end wall 25. An air delivery port 21 is located in first end wall 20 and an air intake port 26 is located in second end wall 25.

Air circulation system 70 includes a blower 71 and a heater 80 disposed in duct system 30 for circulating air through duct system 30, out of air delivery port 21 as a stream of heated circulating air 90 across surface 14 of bin 11 and into air intake port 26 as shown by the directional arrows 95 and 98 in FIG. 2. Heated air circulating stream 90 moves from air delivery port 21 toward air intake port 26 over top surface 14 and contacts food product 16 as shown by arrows 93 to provide a second source of heat to warm food product 16.

Thus, food product 16 is warmed by a combination of heat that emanates from heated plate 13 and heat from the warm air of heated air circulating stream 90.

Referring to FIGS. 2 through 5, the circulating air entering air intake port 26 into second wall duct passage 60 is formed by a mixture of ambient air 94 and air from circulating air stream 90 drawn through intake port 26. The circulating air is drawn through blower 71 and directed through a pair of blower output ports 32 and 33 into bottom duct passage 31 where it travels through heater 80. The heated circulating air is then directed up first duct passage 50 and out air delivery port 21 to form heated air circulating stream 90.

Air delivery port 21 has baffles 22 that are positioned to direct heated air circulating stream 90 downwardly toward top surface 14 and food product 16. Air intake port 26 has baffles 27 that are positioned to capture both ambient air 94 and air from heated air circulating stream 90.

A drive motor 72 operates blower 71. A control unit 73 is provided to control the speed of motor 72 as well as the heat produced by heaters 15 and 80. An electrical power connector 74 is provided to apply operating power from an external electrical power source to motor 72, heaters 15 and 80 and control unit 73.

An important aspect of the present invention is controlling the balance of the circulating air that exits air delivery port 21 with the air entering air intake port 26. This balancing provides optimum air flow and temperature to isolate food product 16 from cooling by ambient air 94. This balance is achieved by diverting a portion of the circulating air to a bleed exhaust port 18.

Figure 3:
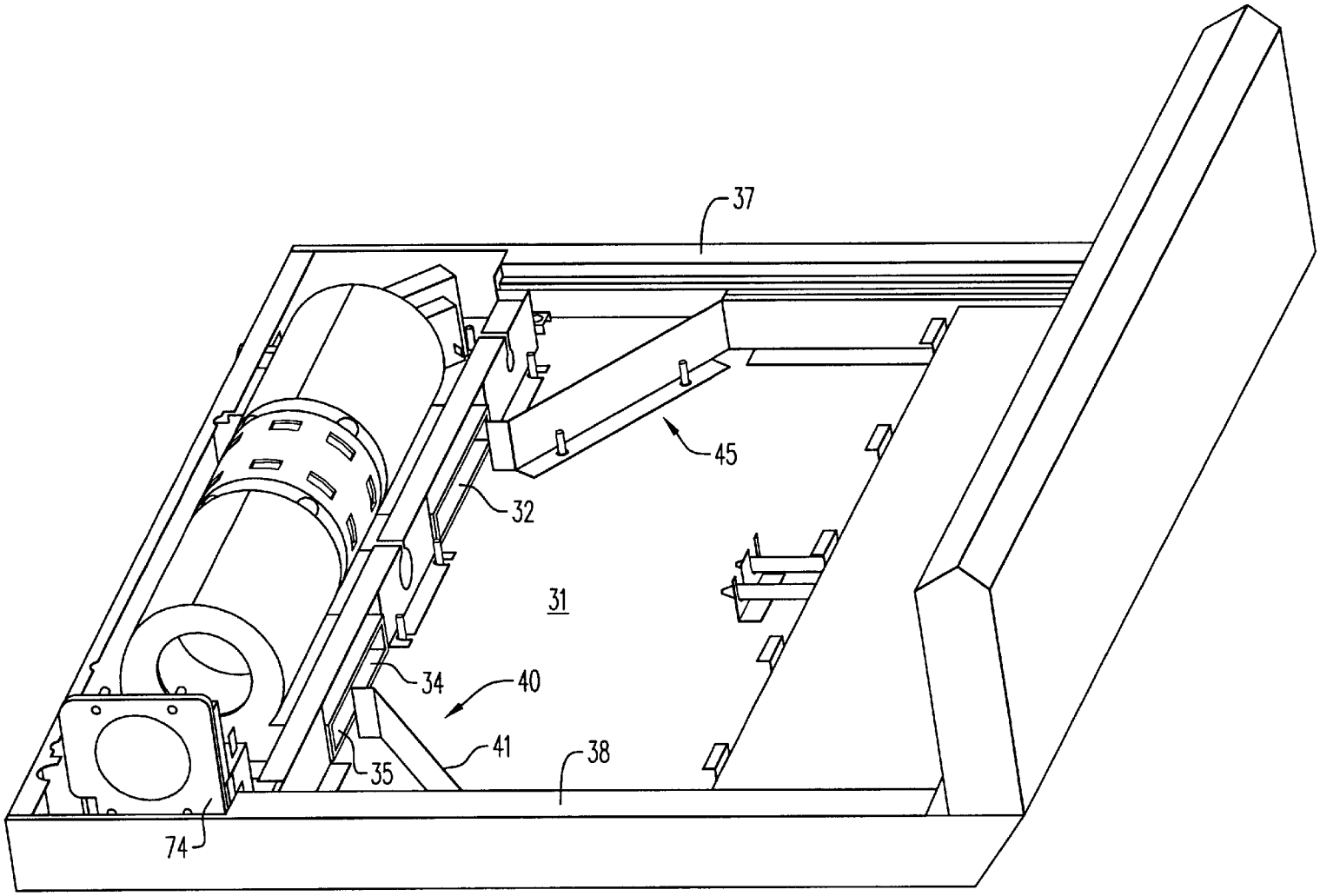
FIG. 3 is another perspective view of the food-warming device according to the present invention with portions of the external surface removed.
Figure 4:
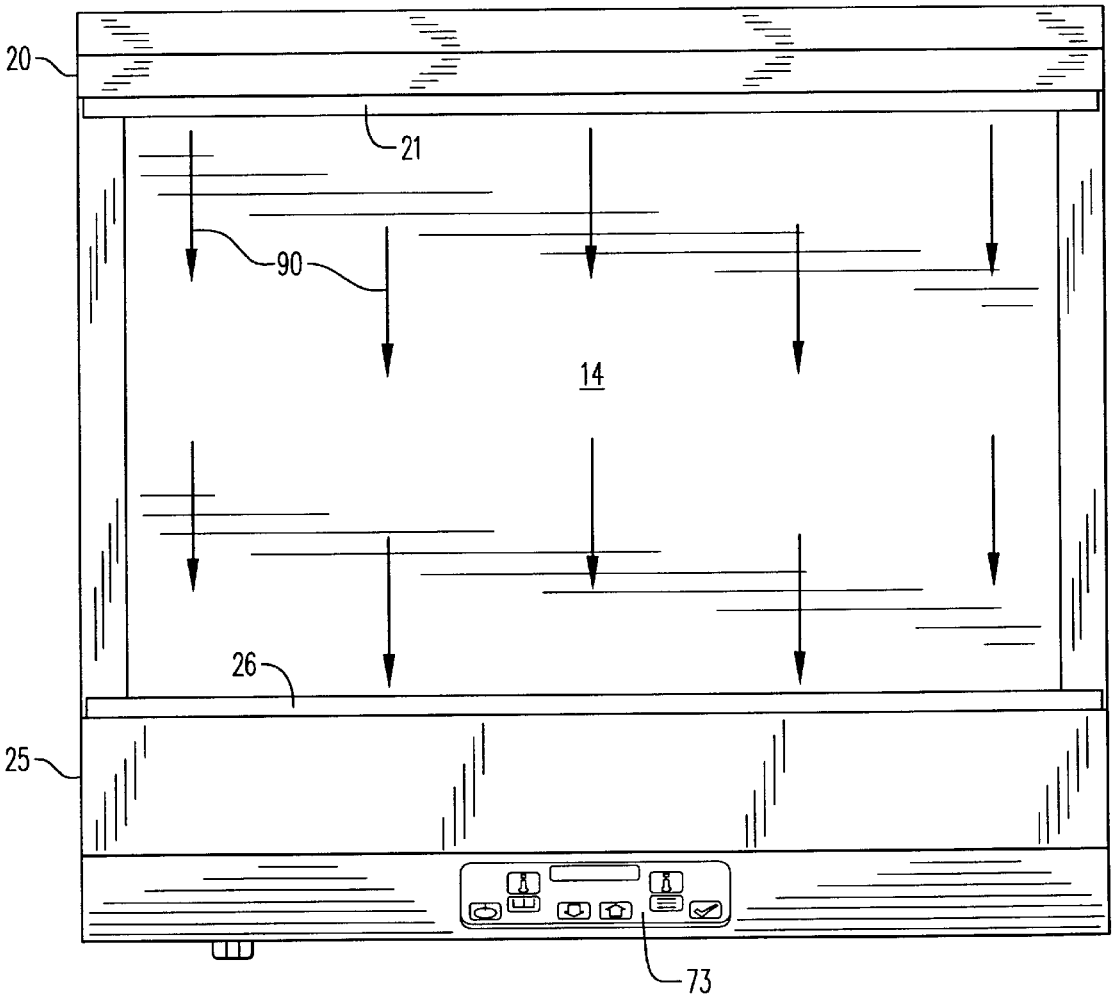
FIG. 4 is a top view of the food warming device of FIG. 1.
Figure 5:
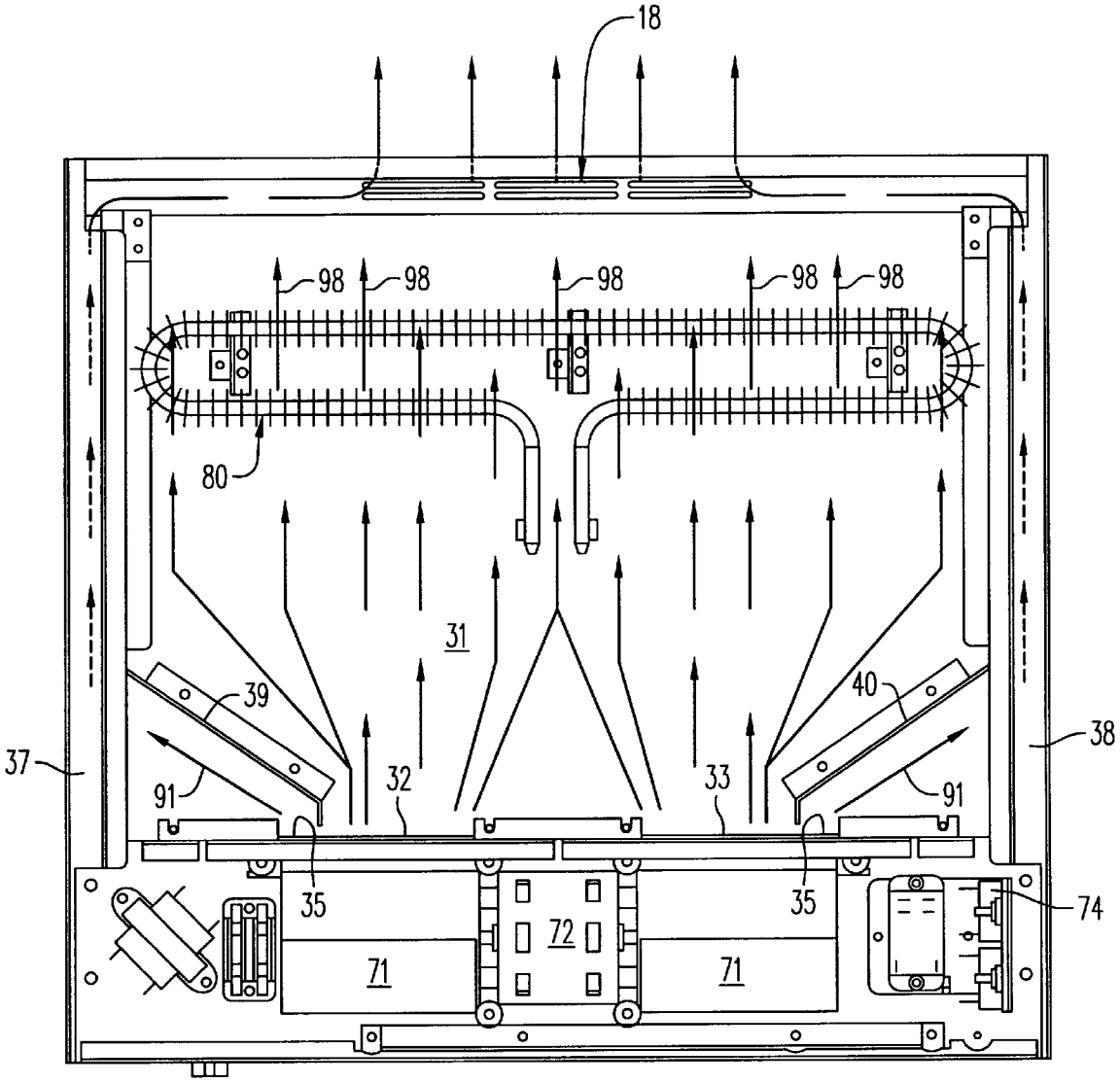
FIG. 5 is another top view of the food-warming device of FIG. 1 with surface portions removed.

Referring to FIGS. 3 and 5, the circulating air is balanced by means of bleed exhaust port 18, bleed ducts 37 and 38 and bleed dividers 40 and 45. Bleed dividers 40 and 45 act to allocate the circulating air exiting blower output ports 32 and 34 between duct passage 31 and bleed ducts 40 and 45. Bleed divider 40 has a baffle 41 arranged to direct a bleed air 91 by capturing a portion of the circulating air from portion 35 of blower output port 34. Bleed air 91 is directed by baffle 41 into and through bleed duct 38 and out bleed exhaust port 18. Bleed divider 45 has a baffle 46 arranged to direct bleed air 91 by capturing a portion of the circulating air from portion 33 of blower output port 32. Bleed air 91 is directed by baffle 46 into and through bleed duct 37 and out bleed exhaust port 18.

The bleed ducts 37 and 38 have external surfaces that are located in areas exposed to touching by hands of those who tend or work with food-warming device 10. Bleed air 91 flowing through bleed ducts 37 and 38 cools these external surfaces to the touch.

The method of warming a food product according to the present invention involves positioning food product 16 on heated plate 13. Air is circulated to form circulating stream of heated air 90. Circulating air stream 90 is directed over heated plate 13 and in contact with food product 16. Food product 16 is warmed by heat emanating from heated plate 13 and by the heated air from circulating stream of heated air 90.

In a preferred embodiment, the method further involves forming the circulating air with a mixture of air from circulating stream of heated air 90 and ambient air. The circulating air is maintained in balance by diverting a portion of the air mixture to ambient atmosphere.

The present invention having been thus described with particular reference to the preferred forms thereof, it will be obvious that various changes and modifications may be made therein without departing from the spirit and scope of the present invention as defined in the appended claims.

What is claimed is:

1. A food-warming device for maintaining food products warm, said device comprising:

a food product bin having a bottom portion with a surface for receiving food products to be warmed, said bottom portion having first and second opposed edges and third and fourth opposed edges, first and second end walls disposed at said first and second opposite edges of said bottom portion, the regions above said bottom portion and along said third and fourth opposite edges between said first and second walls being substantially open to ambient atmosphere;

a duct system arranged in said bottom portion and in said first and second end walls, said system including an air delivery port in said first wall and an air intake port in said second wall, wherein said air delivery port and said air intake port oppose each other;

means for circulating air through said duct system, out said air delivery port and in said air intake port to form a stream of circulating air over said surface and between said surface and said region;

means for heating said surface and said circulating air; and air directing means for directing said stream of circulating heated air to contact said food products, whereby said food products are warmed from below by said heated surface and by contact with said circulating stream of heated air.

2. The food-warming device according to claim 1, wherein the means for heating includes a first heater disposed to heat said surface and a second heater disposed in said duct system to heat said circulating air.

3. A food-warming device for maintaining food products warm, said device comprising:

a food product bin having a bottom portion with a heated surface for receiving food products to be warmed and first and second end walls disposed at opposite edges of said bottom portion;

a duct system arranged in said bottom portion and in said first and second end walls, said system including an air delivery port in said first wall and an air intake port in said second wall, wherein said air delivery port and said air intake port oppose each other;

means for circulating air through said duct system, out said air delivery port and in said air intake port to form a stream of circulating heated air over said heated surface;

a first heater disposed to heat said surface and a second heater disposed in said duct system for heating said circulating air;

air directing means for directing said stream of circulating heated air to contact said food products, whereby said food products are warmed from below by said heated surface and by contact with said circulating stream of heated air, wherein said circulating air that enters said air intake port is a mixture of ambient air and air from said stream of circulating heated air; and balancing means for maintaining said circulating air in balance, said balancing means including a bleed exhaust port and a bleed divider means for directing (1) a first portion of said circulating air to said air delivery port and (2) a second portion of said circulating air to said bleed exhaust port.

4. The food-warming device according to claim 3, wherein said circulating means includes a blower having output port means through which said circulating air is ported, and wherein said bleed divider means comprises baffle means disposed to direct said first and second portions of said circulating air.

5. The food-warming device according to claim 4, wherein said bottom portion has first, second, third and fourth edges, said apposite edges being said first and second edges, and wherein said bleed duct means comprises first and second bleed ducts are disposed along said third and fourth edges, respectively; wherein said first and second bleed ducts having external surfaces in a location exposed to touching by human hands, and wherein said second heater is disposed in said duct system down stream of said blower and said bleed divider means so that said second portion of circulating air serves to cool said external surfaces of said bleed ducts.

6. A food-warming device for maintaining food products warm, said device comprising:

a food product bin having a bottom portion with first and second opposed edges and third and fourth opposed edges, first and second end walls disposed at said first and second opposite edges of said bottom portion, the regions above said bottom portion and along said third and fourth opposite edges between said first and second walls being substantially open to ambient atmosphere, said bottom portion having a surface for receiving food products to be warmed;

an air circulating system arranged to form a stream of circulating air that moves from an air delivery port disposed in said first end wall over said heated surface to an air intake port disposed in said second end wall;

means for heating said surface and said circulating air; whereby said food products are warmed by heat emanating from said heated surface and by warm air from said stream of circulating heated air.

7. The food-warming device according to claim 6, wherein said air circulating system includes a duct system disposed in said bottom portion and in said first and second end walls.

8. The food-warming device according to claim 7, wherein the means for heating includes a first heater disposed to heat said surface and a second heater disposed in said duct system to heat said circulating air.

9. A food-warming device for maintaining food products warm, said device comprising:

a food product bin having a bottom portion with first and second opposed edges and third and fourth opposed edges, first and second end walls disposed at said first and second opposite edges of said bottom portion, the regions above said bottom portion and along said third and fourth opposite edges between said first and second walls being substantially open, said bottom portion having a surface for receiving food products to be warmed;

an air circulating system including a duct system disposed in the bottom portion and in the first and second end walls, the air circulating system being arranged to form a stream of circulating heated air that moves from an air delivery port disposed in said first end wall over said surface to an air intake port disposed in said second end wall;

a first heater disposed to heat said surface and a second heater disposed in said duct system for heating said circulating air; whereby said food products are warmed by heat emanating from said heated surface and by warm air from said stream of circulating heated air, wherein said circulating air that enters said air intake port is a mixture of ambient air and air from said stream of circulating heated air; and balancing means for maintaining said circulating air in balance, said balancing means including a bleed exhaust port and a bleed divider means for directing (1) a first portion of said circulating air to said air delivery port and (2) a second portion of said circulating air to said bleed exhaust port.

10. The food-warming device according to claim 9, wherein said air circulating means includes a blower having out put port means through which said circulating air is ported, and wherein said bleed divider means comprises baffle means disposed to direct said first and second portions of said circulating air.

11. The food-warming device according to claim 10, wherein said bleed duct means comprises first and second bleed ducts disposed along said third and fourth edges, respectively.

12. The food-warming device according to claim 11 wherein said first and second bleed ducts have external surfaces in a location exposed to touching by human hands, and wherein said second heater is disposed in said duct system down stream of said blower and said bleed divider means so that said second portion of circulating air serves to cool said external surfaces of said bleed ducts.

13. The food-warming device according to claim 12, wherein said bleed exhaust port is located in said bottom portion at said first edge.

14. A method of warming a food product, said method comprising:

positioning said food product on a plate that has first and second opposed edges and third and fourth opposed edges and first and second walls extending from said first and second opposed edges, the region that extends above the plate and along said third and fourth opposed edges being open to ambient atmosphere;

circulating air to form a circulating stream of air;

heating said plate and said circulating air; and directing said stream of circulating heated air over said heated plate and in contact with said food product to form a moving air curtain between said plate and said ambient atmosphere; whereby said food product is warmed by heat emanating from said heated plate and by contact with said stream of circulating heated air.

15. The method according to claim 14, and further comprising:

forming said circulating air with a mixture of air from said stream of circulating heated air and ambient air; and maintaining said circulating air in balance with said circulating stream of heated air by directing a first portion of said air mixture to form said stream of circulating heated air and a second portion of said air mixture to ambient atmosphere.

* * * * *